US006685374B1

(12) United States Patent
Cetera

(10) Patent No.: US 6,685,374 B1
(45) Date of Patent: Feb. 3, 2004

(54) BIG CLIP PEN

(75) Inventor: Carl Cetera, Tenafly, NJ (US)

(73) Assignee: Cotapaxi, Inc., Englewood, NJ (US)

( * ) Notice: Subject to any disclaimer, the term of this patent is extended or adjusted under 35 U.S.C. 154(b) by 0 days.

(21) Appl. No.: 10/435,313

(22) Filed: May 9, 2003

(51) Int. Cl.[7] ..... B43K 23/02
(52) U.S. Cl. ..... 401/131; 24/11 M; 24/11 P
(58) Field of Search ..... 401/104, 131, 401/243, 244; 24/11 M, 11 P

(56) References Cited

U.S. PATENT DOCUMENTS

| | | | |
|---|---|---|---|
| 276,512 | A | 4/1883 | Webster |
| 1,073,053 | A | 9/1913 | Lawson |
| 1,404,863 | A | 1/1922 | Klenck |
| 1,713,380 | A | 5/1929 | Green |
| 1,808,045 | A | 6/1931 | Krause |
| 2,272,674 | A | 2/1942 | Kehr |
| 3,227,948 | A | 1/1966 | Cheshire |
| 3,412,436 | A | 11/1968 | Darst |
| 4,424,923 | A | 1/1984 | Bingham |
| 4,516,869 | A | 5/1985 | Corpataux |
| 4,981,382 | A | 1/1991 | Murphy |
| 5,075,931 | A | 12/1991 | van Kuijk |
| 5,361,459 | A | 11/1994 | Hyvonen |
| 5,651,626 | A | 7/1997 | Chen |
| 5,678,281 | A | 10/1997 | Kamp |
| 5,845,985 | A | 12/1998 | Xiong |
| 6,280,110 | B2 | 8/2001 | Lin |
| 6,286,736 | B1 | 9/2001 | Angus |
| 6,332,247 | B1 | 12/2001 | Hsieh |

*Primary Examiner*—Tuan N. Nguyen
(74) *Attorney, Agent, or Firm*—Mark D. Nielsen; The Soni Law Firm

(57) ABSTRACT

A clip assembly securably affixable to the body of a variety of hand-held implements, including writing devices, which is capable of clasping objects substantially thicker that a garment pocket, such as notepads, books, and backpacks. The clip assembly comprises a pin securably engaged to the body of the hand-held implement, a rigid member having a first end for clasping an article, and a second end for manually operating the clip assembly, and a spring biasing the first end of the rigid member towards the body of said hand-held writing implement. The rigid member operably engages the pin in a manner that permits the rigid member to rotate relative to the body of the hand-held implement when a yielding pressure is applied to the second end of the rigid member.

22 Claims, 2 Drawing Sheets

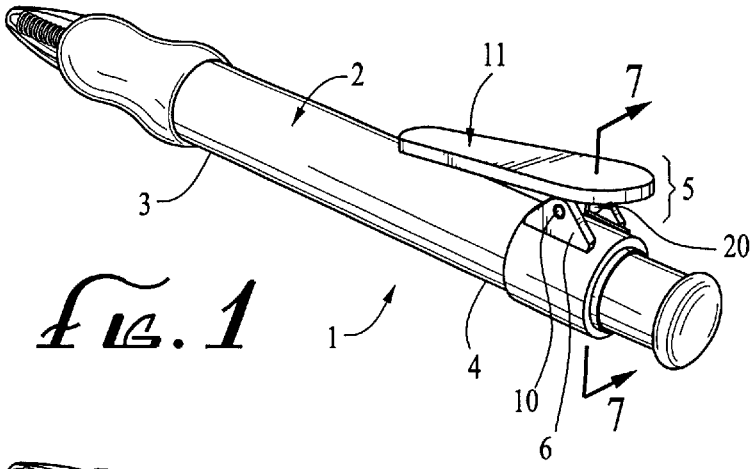
FIG. 1
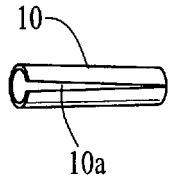
FIG. 2
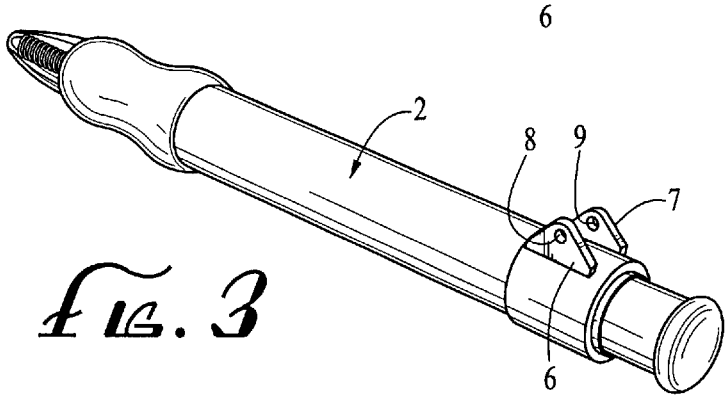
FIG. 3
FIG. 4
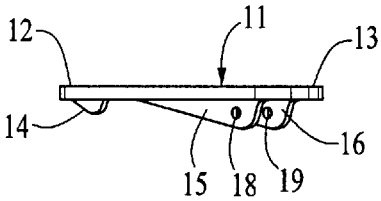
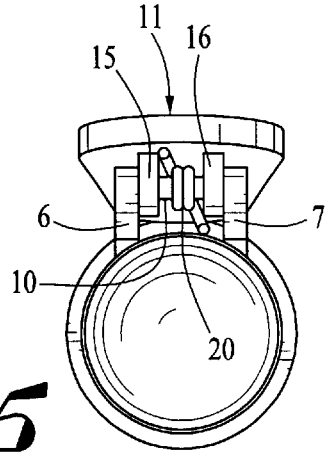
FIG. 5

BIG CLIP PEN

BACKGROUND OF THE INVENTION

The present invention relates to a new type of clip assembly that can be used to temporarily attach or secure a writing implement such as a pen or other hand-held instrument to a variety of anchoring points (i.e. the object to which the clip is attached) and effortlessly detach the instrument from the anchoring point whenever the user so desires. Such anchoring points may be of a greater thickness than those anchoring points to which present clip designs are capable of securely attaching.

Clips on writing implements and small handheld instruments are well known. Such clips are commonly utilized to secure or anchor a writing instrument to the pocket of a shirt or similar garment. A significant disadvantage of prior known clips for such objects is that the clip is only capable of anchoring the instrument to a thin piece of material. Such prior known clips are either mechanically incapable of anchoring to thicker materials, or doing so places inordinate stress on the clip such that it is likely to break, bend, incur damage, and/or permanently lose holding strength when returned to a thinner anchoring point.

Additionally, the clasping power of prior known clips against the anchoring point is often insufficient to secure the handheld instrument. Prior known clips with more substantial anchoring force are often too bulky or heavy to attach to a shirt pocket or are incompatible with a small, hand-held instrument. Furthermore, prior known clips with substantial clasping force often cause deformity, destruction, or damage to an anchoring point that becomes evident upon removal of the clip.

For the foregoing reasons, there is a need for a clip that may be used upon a hand-held writing instrument or other hand-held instruments that is sturdy, opens wide, is not too bulky or heavy to attach to a shirt pocket, and is sufficiently strong to securably clasp thicker more voluminous objects that a garment pocket or several pieces of paper.

SUMMARY OF THE INVENTION

The present invention provides for a novel clip assembly comprising a clip, or rigid member, that clasps to an anchoring point, a pin or pin-like structure, and a spring, that may be permanently affixed to a hand-held implement. In essence, the invention provides for a hand-held implement, such as a writing implement, the body of which includes flanges with holes to receive a pin or pin-like structure, wherein the pin or pin-like structure comprises a substantially cylindrical metallic element including a slit that substantially or completely occupies the long axis of the pin or pin-like structure. The pin or pin-like structure is passed through holes on the underside of a rigid member as well as the coil of a spring wound around the pin or pin-like structure such that the rigid member is hingedly attached to the hand-held implement. The rigid member contains a first end that clasps an article, and a second end for manually operating the rigid member.

The present invention satisfies the need for a hand-held device such as a pen capable of clasping anchoring points of varying thickness, but generally increased thickness compared to that of a garment pocket. The present invention provides for a wide-angle clip adapted for inclusion on various hand-held implements, including, but not limited to, writing implements. The wide-angle clip is further adapted for attachment to various "thick" objects including, but not limited to, backpacks, belts, coats, books, and note pads. An advantage of the clip described herein is that it permits a hand-held implement (e.g., a pen) to be attached to objects that have a thickness greater than that of a typical shirt pocket without destruction or damage to the clip or to the article to which the clip is attached. The clip is also capable of securely attaching the hand-held implement to conventional thin anchoring points, such as a shirt pocket, without difficulty. The hand-held implement described herein can be freely and easily detached from an anchoring point by a user. The present invention, therefore, has an advantage of versatility, ease of use, and increased clasping strength over conventional clips found on hand-held implements such as writing implements.

An additional desirable feature of the present invention, in some embodiments, is that the clip can be made in various shapes and sizes without sacrificing the functional features of the clip. The versatility in the size and shape of the clip can be adapted for the purpose of placing advertisements on the surface of the clip, which would be viewable by others even if the barrel of the hand-held instrument was within a pocket or in the user's hand.

In some embodiments, the clip is wider than conventional clips in order to attain a larger surface area necessary to increase the clasping power of the clip against the object to which the clip is attached or to increase the surface area upon which advertising indicia, for example, is printed.

BRIEF DESCRIPTION OF THE DRAWINGS

FIG. 1 is a perspective view of a hand-held implement for writing or marking.

FIG. 2 is a side view of the pin or pin-like structure (referred to below as ("guide pin").

FIG. 3 is a perspective view of the hand-held implement for writing or marking shown in FIG. 1 absent the clip assembly.

FIG. 4 is an oblique side view of the rigid member.

FIG. 5 is a top plan view of the hand-held implement for writing or marking shown in FIG. 1 with the rigid member in the closed position.

DETAILED DESCRIPTION OF PREFERRED EMBODIMENT

Figure 6:
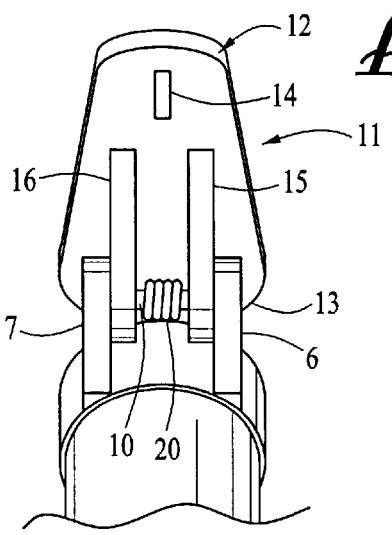
FIG. 6 is a close-in, oblique bottom plan view of the hand-held implement for writing or marking shown in FIG. 1 with the rigid member in the open position.

Referring to FIG. 1, a perspective view of the hand-held implement for writing or marking containing the clip assembly detailed herein is illustrated. The hand-held writing implement 1 contains a body 2 with an upper 3 and lower 4 section and has a large clip assembly 5 permanently attached to the body. The clip assembly contains a pin 10 (see FIG. 2), a rigid member 11, and a helical coil spring 20.

Referring to FIG. 2, the pin or pin-like structure 10 is shown. The pin or pin-like structure (referred to hereafter as "guide pin") is a hollow, substantially cylindrical metallic element containing a slit 10*a* that at least substantially traverses the longitudinal axis of the guide pin. The guide pin 10 is slightly tapered being wider at one end than at the other end of the guide pin. In alternate embodiments, the guide pin could be a solid, substantially cylindrical metallic object adapted to be permanently housed between the body flanges 6, 7 (see FIG. 3) and clip flanges 15, 16 (see FIG. 4).

Referring to FIG. 3, a perspective view of the hand-held implement for writing or marking absent the clip assembly is illustrated. The body 2 contains two body flanges 6, 7 that extend outwardly from the body. Each body flange 6, 7 contains an engagement structure, which is a hole 8, 9, passing through each body flange, or, in alternative embodiments, could be a recess on the inner face of each body flange, or a combination of a hole and a recess. One of the holes 8, 9 is of a slightly smaller diameter than the other so that the tapered guide pin 10 is permanently housed between the body flanges 6, 7 and to prevent the guide pin from sliding out of the holes once inserted therein. The holes 8, 9 are elevated relative to the body 2 and serve to securedly house the guide pin 10 about which the rigid member 11 pivots (see FIGS. 4 and 5). The guide pin 10, which contains a longitudinal axis, traverses the holes 8, 9 in the body flanges 6, 7.

Referring to FIGS. 4–6, an oblique side view of the rigid member (FIG. 4), a top plan view of the hand-held implement for writing or marking containing the clip assembly with the rigid member in the closed position (FIG. 5), and an oblique bottom plan view of the hand-held implement for writing or marking containing the clip assembly with the rigid member in the open position (FIG. 6), are illustrated. The rigid member 11 contains a first end 12, which contains a small protrusion 14 for engaging an article such as a garment, large pad of paper, book, or a backpack, and a second end 13 for manually operating the clip assembly 5 and pivoting the rigid member 11 away from the body of the hand-held implement for writing or marking. The rigid member 11 contains two clip flanges 15, 16 that extend in a substantially perpendicular direction from the inner surface 17 of the rigid member. Each clip flange 15, 16 contains an engagement structure, which is a hole 18, 19 passing through each clip flange (see FIG. 4). The holes 18, 19 serve to securedly house the guide pin 10 about which the rigid member 11 pivots (see FIGS. 5 and 6). The guide pin 10 traverses the holes 18, 19 on the clip flanges 15, 16. An alternate embodiment of the rigid member could be constructed wherein only one large clip flange were present and with only one hole boring completely through the clip flange.

Figure 7:
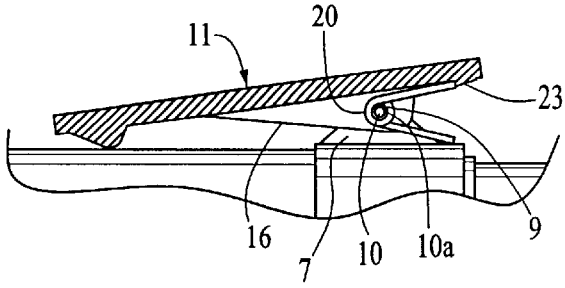
FIG. 7 is a close-in, partial cross-section cut along line 7—7 of FIG. 1.

Referring to FIG. 7, a cross-section perpendicular to the long axis of the guide pin 10 located along the inner face of one of the clip flanges is shown. A spring, 20, preferably a helical coil spring, having a first end 21 that abuts a small protrusion 23 between the clip flanges 15, 16 on the second end 13 of the rigid member 11, and a second end 22 that contacts the body 2 between the body flanges 6, 7 (see FIG. 5), is wound around the guide pin 10 and biases the rigid member towards the body. The helical coil spring 20 exerts a biasing force on the rigid member 11 sufficient to cause the first end 12 of the rigid member to contact the body 2 and the second end of the member member to separate from the body. The biasing force exerting by the helical coil spring 20 is also sufficient to grasp or clasp a larger or thicker volume of material to the body than that grasped or clasped by typical clips found on hand-held writing implements. Upon application of a yielding pressure to the second end 13 of the rigid member 11, the first end 12 of the rigid member separates from the body 2 and the second end of the rigid member moves towards the body.

Figure 8A:
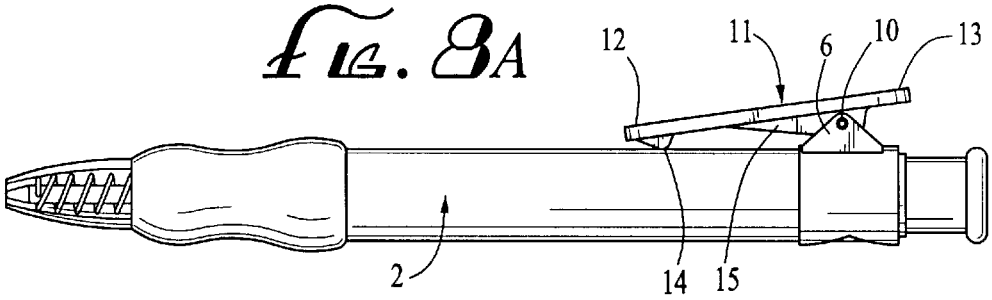
FIG. 8A is a side view of the hand-held implement for writing or marking shown in FIG. 1 with the rigid member in the closed position.
Figure 8B:
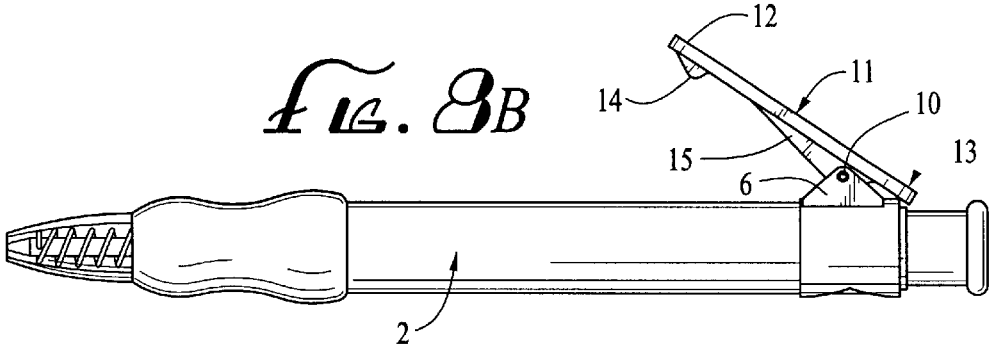
FIG. 8B is a side view of the hand-held implement for writing or marking shown in FIG. 7 with the rigid member in the fully opened position.

As shown in FIGS. 8*a* and 8*b* (side views, clip closed and fully open), the angle of the first end 12 of the rigid member 11 relative to the body 2 that can be achieved is between approximately zero degrees when the first end of the rigid member contacts the body to approximately thirty-five degrees when the second end 13 of the rigid member, in response to a yielding pressure, contacts the body.

In one embodiment of the present invention, advertising may be depicted on the surface of the rigid member 11, where such advertising may be viewed when the hand-held implement for writing or marking is within the user's garment pocket, is clasped to an anchoring point, or in the user's hand.

Alternate embodiments of the invention could include varying the distance from the body 2 to each of the holes 8, 9, 18, 19 and can be varied to permit attachment to articles of greater thickness. In the preferred embodiment, the distance from the body 2 of the pen to the centers of the holes 8, 9, 18, 19 is in the range of 1/16" to 1/4".

In one embodiment of the present invention, the hand-held implement is a writing implement. The body of said writing implement may be constructed of metal, molded plastic, or other materials well known in the art. In alternative embodiments, the present clip assembly invention may be adapted for use on other elongated, hand-held objects where a clip capable of attaching a device to objects thicker than a garment or several pieces of paper is desirable. Such objects may include laser pointers, screwdrivers, flashlights, hand-held devices for measuring tire pressure, and perhaps medical devices used by health-care professionals in the ordinary course of their duties. These devices are each members of a group of hand-held devices constructed that are typically carried on the person attached to a garment or attached to materials such as a pad of paper, a book, a tool belt, a clipboard, or a file folder adapted to contain papers.

Although the above description contains many specifics, these should not be construed as limiting the scope of the invention, but rather as merely providing illustrations of some of the presently preferred embodiments of this invention.

Therefore, the invention has been disclosed by way of example and not limitation, and reference should be made to the following claims to determine the scope of the present invention.

What is claimed is:

1. A hand-held implement for writing or marking, comprising:

(a) a body, including body flanges;

(b) a writing or marking instrument included in the body;

(c) a clip assembly, comprising:

(1) a rigid member for securably clasping a large volume of, or thick, material between the body and the rigid member without deformation or breaking of the rigid member, having a first end where material is held against the body, and a second end for manually pivoting the rigid member away from the body;

(2) a spring biasing said first end of the rigid member towards the body, said spring being sufficiently strong to grasp a large volume of, or thick, material between the first end of the rigid member and the body; and (d) a guide pin securing the clip assembly to the body flanges, said guide pin consists of a tapered cylindrical element with a slit along its longitudinal axis.

2. A hand-held implement for writing or marking as claimed in claim 1, wherein said clip assembly is permanently attached to the body of said hand-held implement.

3. A hand-held implement for writing or marking as claimed in claim 2, wherein the guide pin is elevated relative to the body.

4. A hand-held implement for writing or marking as claimed in claim 2, wherein said spring is a helical coil spring.

5. A hand-held implement for writing or marking as claimed in claim 2, wherein advertising is depicted on the surface of the rigid member, said advertising being viewable when the hand-held implement for writing or marking is within the user's garment pocket, is clasped to an anchoring point, or in the user's hand.

6. A hand-held implement for writing or marking as claimed in claim 1, wherein the guide pin is elevated relative to the body.

7. A hand-held implement for writing or marking as claimed in claim 1, wherein said spring is a helical coil spring.

8. A hand-held implement for writing or marking as claimed in claim 1, wherein said body flanges include one or more holes that receive the guide pin.

9. A hand-held implement for writing or marking as claimed in claim 1, wherein said rigid member contains at least one flange, which includes a hole that receives the guide pin.

10. A hand-held implement for writing or marking as claimed in claim 9, wherein said rigid member comprises a protrusion on the inner surface of said rigid member in proximity to the first end of said rigid member and in contact with the body when the clip assembly is at rest.

11. A hand-held implement for writing or marking as claimed in claim 1, wherein the first end of said rigid member has a maximum angular displacement of approximately 35 degrees relative to the body.

12. A hand-held implement for writing or marking as claimed in claim 1, wherein advertising is depicted on the surface of the rigid member, said advertising being viewable when the hand-held implement for writing or marking is within the user's garment pocket, is clasped to an anchoring point, or in the user's hand.

13. A hand-held implement, comprising:

(a) a body, including body flanges;

(b) a clip assembly, comprising:

(1) a rigid member for securably clasping a large volume of, or thick, material between the body and the rigid member without deformation or breaking, having a first end where material is held against the body, and a second end for manually pivoting the rigid member away from the body;

(2) a spring biasing said first end of the rigid member towards the body, said spring being sufficiently strong to grasp a large volume of, or thick, material between the first end of the rigid member and the body;

(c) a guide pin securing the clip assembly to the body flanges, said guide pin comprised of a tapered cylindrical element with a slit along its longitudinal axis, and said guide pin being elevated relative to the hand-held implement; and (d) the hand-held implement is selected from the group consisting of a writing instrument, a laser pointer, a stylus pen, a multi-function writing instrument, a screwdriver, and a tire pressure gauges.

14. A hand-held implement as claimed in claim 13, wherein said clip assembly is permanently attached to the body of said hand-held implement.

15. A hand-held implement as claimed in claim 14, wherein the body includes a pair of body flanges, each of which contain a hole to receive said guide pin, wherein said guide pin comprises a tapered cylindrical element with a slit along its long axis, and said guide pin being elevated relative to the hand-held implement.

16. A hand-held implement as claimed in claim 14, wherein said spring is a helical coil spring.

17. A hand-held implement as claimed in claim 14, wherein advertising is depicted on the surface of the rigid member, said advertising being viewable when the hand-held implement for writing or marking is within the user's garment pocket, is clasped to an anchoring point, or in the user's hand.

18. A hand-held implement as claimed in claim 13, wherein the body includes a pair of body flanges, each of which contain a hole to receive said guide pin.

19. A hand-held implement as claimed in claim 13, wherein said spring is a helical coil spring.

20. A hand-held implement as claimed in claim 13, wherein said rigid member contains at least one flange, which includes a hole that receives the guide pin.

21. A hand-held implement as claimed in claim 13, wherein the first end of said rigid member has a maximum angular displacement of approximately 35 degrees relative to the body of said hand-held implement.

22. A hand-held implement as claimed in claim 13, wherein advertising is depicted on the surface of the rigid member, said advertising being viewable when the hand-held implement for writing or marking is within the user's garment pocket, is clasped to an anchoring point, or in the user's hand.

* * * * *